United States Patent [19]

Passal

[11] 3,969,399

[45] July 13, 1976

[54] ELECTROPLATING PROCESSES AND COMPOSITIONS

[75] Inventor: Frank Passal, Detroit, Mich.

[73] Assignee: M & T Chemicals Inc., Greenwich, Conn.

[22] Filed: Oct. 26, 1971

[21] Appl. No.: 192,612

Related U.S. Application Data

[62] Division of Ser. No. 55,959, July 17, 1970, Pat. No. 3,697,391.

[52] U.S. Cl. ..... 260/513 R; 260/513 B

[51] Int. Cl.[2] ..... C07C 143/04; C07C 143/10

[58] Field of Search ..... 260/513 R, 513 B

[56] References Cited

UNITED STATES PATENTS

| | | | |
|---|---|---|---|
| 2,140,291 | 12/1968 | Jenkins | 260/513 R X |
| 2,544,562 | 3/1951 | Michael | 260/513 B X |
| 3,089,888 | 5/1963 | Mayhew et al. | 260/458 |
| 3,114,687 | 12/1963 | Brandt | 204/112 |
| 3,149,152 | 9/1964 | Boehme | 260/513 B |
| 3,506,548 | 4/1970 | Duchene | 204/49 |
| 3,697,391 | 10/1972 | Passal | 204/43 |

OTHER PUBLICATIONS

Beilstein, "Handbuch der Organischen Chemie," vol. 4, p. 19 (1922); vol. 4, first supplement, pp. 311–312 (1929).

J. Ekeley, JACS 50 pp. 2731–2733 (1928).

M. Hori, Chem. Abstracts 45, 4202c (1951).

M. Rubin, Chem. Abstracts 56, 1369g.

*Primary Examiner*—James O. Thomas, Jr.
*Assistant Examiner*—Nicky Chan
*Attorney, Agent, or Firm*—Kenneth G. Wheeless; Robert P. Auber; Robert Spector

[57] ABSTRACT

In accordance with certain of its aspects, this invention relates to a process for the preparation of an electrodeposit which contains at least one metal selected from the group consisting of nickel and cobalt which comprises passing current from an anode to a cathode through an aqueous plating solution containing a member selected from the group consisting of cobalt compounds and nickel compounds providing cobalt or nickel ions for electrodepositing cobalt or nickel and containing in combination an effective amount of:

1. at least one member selected from the group of cooperating additives consisting of:
   a. primary brightener
   b. secondary brightener
   c. secondary auxiliary brightener
   d. anti-pitting agent; and
2. an organic hydroxy-sulfonate compound of the formula:

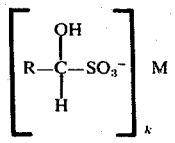

wherein M is a cation having a valence of 1–2; k is an integer 1–2 corresponding to the valence of M; and R is hydrogen or a monovalent aliphatic group of 1–16 carbon atoms; for a time period sufficient to form a sound metal electroplate upon said cathode surface.

1 Claim, No Drawings

ELECTROPLATING PROCESSES AND COMPOSITIONS

This application is a divisional application of Ser. No. 55,959, filed July 17, 1970, now U.S. Pat. No. 3,697,381.

This invention relates to improved processes and compositions for the electrodeposition of nickel, cobalt, and alloys thereof. More particularly, this invention relates to the use of new additives to improve the tolerance of nickel, cobalt, and alloy plating baths containing nickel and/or cobalt to the adverse effects of both metallic impurities and relatively high concentrations of primary brighteners.

It has been found that the presence of metallic impurities (particularly zinc) tends to produce plating defects during the electrodeposition of nickel-containing, cobalt-containing, and nickel-cobalt-containing electroplates using bath compositions containing primary and secondary brighteners. When zinc is the metallic contaminant, the problem may become especially acute during plating when the secondary brightener is saccharin. In this case, inadequate basis metal coverage may occur in low current density areas; unsightly striated (ribbed) deposits may occur; and dark, thin, nonmetallic appearing deposits may be produced which not only detract from the final appearance of the article being plated, but may also interfere with the receptivity, appearance, luster, etc. of subsequent deposits such as chromium plate. These detrimental metallic contaminants may be introduced as impurities into the plating bath composition in various ways. The impurities may be introduced when commercial grade salts are used to prepare the bath composition, or the metallic impurities may occur as a result of dissolution of parts which may fall into the plating bath composition during the plating process.

It may often occur through mistake or otherwise when plating nickel, cobalt, or nickel-cobalt alloy plate that excessive replenishing amounts of primary brighteners are inadvertently used. Because primary brighteners are ordinarily used in relatively low concentrations, the analytical determination and control of the amounts of these primary brighteners which must be added to replenish the bath composition may be required much more frequently than other types of bath additives. Yet, when excessive amounts of primary brighteners are inadvertently added, the electrodeposit obtained may be as defective as that obtained when large amounts of metallic impurities are present.

Various additives including sodium bisulfite and sodium thiosulfate have been used in nickel plating bath compositions in order to attempt to improve the tolerance of the bath composition to metallic ipurities (particularly zinc), but for various reasons prior art additives have given only temporary improvement and have often produced additional problems as serious as the problem sought to be alleviated.

It is an object of this invention to produce sound electrodeposits of semi-bright or bright-nickel, -cobalt, and alloys of nickel and cobalt. A special object of this invention is to provide processes and compositions for the production of sound electrodeposits containing nickel and/or cobalt over a wide range of concentrations of primary brighteners and/or metallic impurities. Other objects of the invention will be apparent from the following detailed description of the invention.

In accordance with certain of its aspects, this invention relates to a process for the preparation of an electrodeposit which contains at least one metal selected from the group consisting of nickel and cobalt which comprises passing current from an anode to a cathode through an aqueous plating solution containing a member selected from the group consisting of cobalt compounds and nickel compounds providing cobalt of nickel ions for electrodepositing cobalt or nickel and containing in combination an effective amount of:

1. at least one member selected from the group of cooperative additives consisting of:
   a. primary brightener
   b. secondary brightener
   c. secondary auxiliary brightener
   d. anti-pitting agent; and
2. an organic hydroxy-sulfonate compound of the formula:

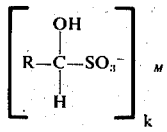

wherein $M$ is a cation having a valence of 1–2; k is an integer 1–2 corresponding to the valence of M; and R is hydrogen or a monovalent aliphatic group of 1–16 carbon atoms; for a time period sufficient to form a sound metal electroplate upon said cathode surface.

The substrates on which the nickel-containing cobalt-containing, or nickel-cobalt-containing electrodeposits of this invention may be applied may be metal or metal alloys such as are commonly electrodeposited and used in the art of electroplating such as nickel, cobalt, nickel-cobalt, copper, tin, brass, etc. Basis metal substrates may have a variety of surface finishes depending on the final appearance desired, which in turn depends on such factors as luster, brilliance, leveling, thickness, etc. of the cobalt or nickel containing electroplate applied on such substrates. Typical substrate basis metals include ferrous metals such as steel; copper; tin; alloys of copper such as brass, bronze, etc.; zinc, particularly in the form of zinc-base die castings which may bear plates of other metals, such as copper, etc.

The term "primary brightener" as used herein is meant to include plating additive compounds such as N-heterocyclics, acetylenics, active sulfur compounds, dye-stuffs, etc. Specific examples of such plating additives are:

1. N-1,2-dichloropropenyl pyridinium chloride
2. 2,4,6-trimethyl N-propargyl pyridinium bromide
3. N-allyl quinaldinium bromide
4. 2-butyne-1,4-diol
5. bis-$\beta$-hydroxyethyl ether of 2-butyne-1,4-diol
6. propargyl alcohol
7. 2-methyl-3-butyn-2-ol
8. thiodipropionitrile

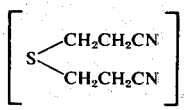

9. thiourea
10. phenosafranin 11. fuchsin

When used alone or in combination, a primary brightener may produce no visual effect on the electrodeposit, or may produce semi-lustrous, fine-grained deposits. However, best results are obtained when primary brighteners are used with either a secondary brightener, a secondary auxiliary brightener, or both in order to provide optimum deposit luster, rate of brightening, leveling, bright plate current density range, low current density coverage, etc.

The term "secondary brightener" as used herein is meant to include aromatic sulfonates, sulfonamides, sufonimides, sulfinates, etc. Specific examples of such plating additives are: 1. saccharin 2. trisodium 1,3,6-naphthalene trisulfonate
3. sodium benzene monosulfonate
4. dibenzene sulfonimide
5. sodium benzene monosulfinate Such plating additive compounds, which may be used singly or in suitable combinations, have one or more of the following functions:

1. To obtain semi-lustrous deposits or to produce substantial grain-refinement over the usual dull, matte, grainy, mon-reflective deposits from additive free baths.

2. To act as ductilizing agents when used in combination with other additives such as primary brighteners.

3. To control internal stress of deposits, generally by making the stress desirably compressive.

4. To introduce controlled sulfur contents into the electrodeposits to desirably affect chemical reactivity, potential differences in composite coating systems, etc. thereby decreasing corrosion, better protecting the basis metal from corrosion, etc.

The term "secondary auxiliary brightener" as used herein is meant to include aliphatic or aromatic—aliphatic olefinically or acetylenically unsaturated sulfonates, sulfonamides, or sulfonimides, etc. Specific examples of such plating additives are:

1. sodium allyl sulfonate
2. sodium-3-chloro-2-butene-1-sulfonate
3. sodium $\beta$-styrene sulfonate
4. sodium propargyl sulfonate
5. monoallyl sulfamide ($H_2N\text{-}SO_2\text{-}NH\text{-}CH_2\text{-}CH{=}CH_2$) 6. diallyl sulfamide

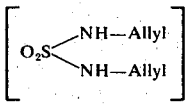

7. allyl sulfonamide

Such compounds, which may be used singly (usual) or in combination have all of the functions given for the secondary brighteners and in addition may have one or more of the following functions:

1. They may act to prevent or minimize pitting (probably acting as hydrogen acceptors)

2. They may cooperate with one or more secondary brighteners and one or more primary brighteners to give much better rates of brightening and leveling than would be possible to attain with any one or any two compounds selected from all three of the classes:

1. primary brightener;
2. secondary brightener; and
3. secondary auxiliary brightener used either alone or in combination.

3. They may condition the cathode surface by catalytic poisoning, etc. so that the rates of consumption of cooperating additives (usually of the primary brightener type) may be substantially reduced, making for better economy of operation and control.

Among the secondary auxiliary brighteners one may also include ions or compounds of certain metals and metalloids such as zinc, cadmium, selenium, etc. which, although they are not generally used at present, have been used to augment deposit luster, etc. When zinc is used as a secondary auxiliary brightener in baths which have a high degree of zinc tolerance, the compositions of the invention may be especially effective to counteract the effects of excessive primary brighteners.

The term "anti-pitting agent" as used herein is meant to include a material (different from and in addition to the secondary auxiliary brightener) which functions to prevent or minimize gas pitting. An anti-pitting agent may also function to make the baths more compatible with contaminants such as oil, grease, etc. by their emulsifying, dispersing, solubilizing, etc. action on such contaminants and thereby promote attaining of sounder deposits. Antipitting agents are optional additives which may or may not be used in combination with one or more members selected from the group consisting of a primary brightener, a secondary brightener, and a secondary auxiliary brightener.

The hydroxy-sulfonate additive compounds of the invention may be prepared according to the following general reaction:

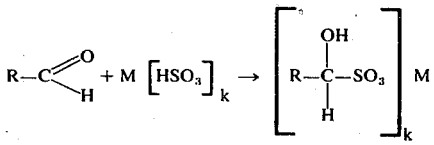

wherein M is a cation having a valence of 1–2; preferably M is an alkali metal or alkaline earth metal cation or ammonium; $k$ is an integer 1–2 corresponding to the valence of M; and R is hydrogen or a monovalent aliphatic group of 1–16 carbon atoms. In the compounds of the above general reaction, R may be an aliphatic radical preferably selected from the group consisting of alkyl, akenyl, alkynyl, cycloalkyl, including such radicals when inertly substituted. When R is alkyl, it may typically be straight chain alkyl or branched alkyl, including methyl, ethyl, n-propyl, isopropyl, n-butyl, isobutyl, sec-butyl, tert-butyl, n-amyl, neopentyl, isoamyl, n-hexyl, isohexyl, heptyls, octyls, decyls, dodecyls, tetradecyl, octadecyl, etc. Preferred alkyl includes lower alkyl i.e. having less than about 8 carbon atoms i.e. octyls and lower. When R is alkenyl, it may typically be vinyl, allyl, 1-propenyl, methallyl, buten-1-yl, buten-2-yl, buten-3-yl, penten-1-yl, hexenyl, heptenyl, octenyl, decenyl, dodecenyl, tetradecenyl, octadecenyl, etc. When R is alkynyl, it may typically be acetylenyl, 2-propynyl, 3-butynyl, etc. When R is cycloalkyl, it may typically be cyclobutyl, cyclopentyl, cyclohexyl, cycloheptyl, cyclooctyl, etc. R may be inertly substituted e.g. may bear a non-reactive substituent such as alkyl, cycloalkyl, alkenyl, ether, halogen, ester,

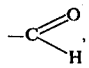

—COOM wherein M is as previously defined), carboxyl (—COOH), hydroxyl, sulfonate, hydroxy-sulfonate ($SO_3M$ such as —$SO_3H$, $SO_3Na$, $SO_3K$, etc.), or other inert or bath-compatible groups, etc. Typical substituted alkyls include 3-hydroxypropyl, 3-chloropropyl, 2-ethoxyethyl, carboethoxymethyl, etc. Substituted alkenyls include 4-hydroxy, 4-chlorobutenyl, ν-phenylpropenyl, chloroallyl, etc. Substituted alkynyls include 4-hydroxy-3-butynyl, propargyl, amine, etc. Substituted cycloalkyls include 4-methylcyclohexyl, 4-chlorocyclohexyl, etc.

The reaction is generally carried out in aqueous media and the reaction products may be left in the form of aqueous stock solutions or the salts may be separated out in crystalline form by evaporation and crystallization or by using organic solvents.

Typical examples of this method of preparing the hydroxy-sulfonate additives of the invention herein include the following:

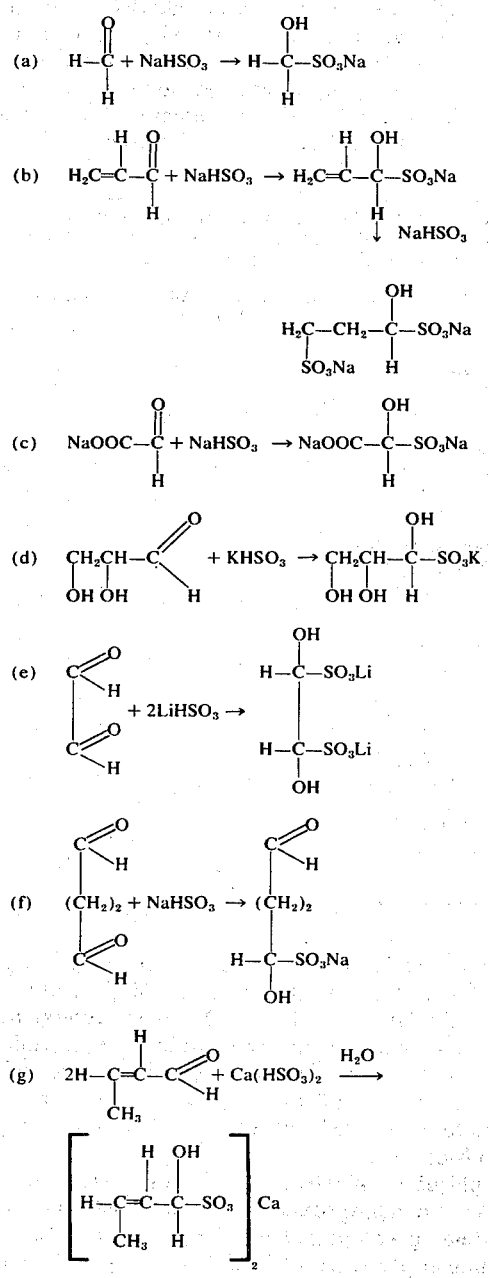

-continued

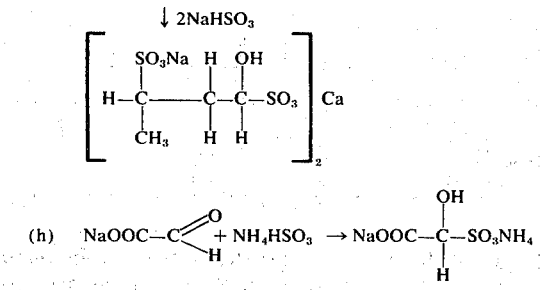

The hydroxy-sulfonate additives of the invention may be used in aqueous nickel, cobalt, and nickel-cobalt electroplating bath compositions in combination with one or more other additives as disclosed herein over fairly wide concentration ranges, typically 0.1–5 g/l or higher. Preferably, when used with the additives described herein the concentration is about 0.5–2 g/l. While concentrations up to saturation may be used, there is no special advantage obtained thereby and the use of excess amounts generally adds to the operating costs of the bath composition. The hydroxy-sulfonate additives of the invention may be added either as solids or in the form of aqueous stock solutions. It has been found that the advantageous results in improved tolerance to metallic impurities (especially zinc) which are obtained using the additives of the invention are unexpectedly persistent even at moderate or low concentrations of hydroxy-sulfonate additive of less than about 1.0 g/l. At concentrations of no more than about 1.0 g/l it has been found that improved zinc tolerance in cobalt, nickel, and nickel-cobalt bath compositions may be obtained for time periods of up to several (4 or 5 ) days and that even bath compositions heavily contaminated with metallic ions show improved tolerance to such ions for at least one day using about 1.0 g/l of hydroxy-sulfonate additive.

Typical nickel-containing, cobalt-containing, and nickel-cobalt-containing bath compositions which may be used in combination with effective amounts of about 0.5–5 g/l of the hydroxy-sulfonate additive compounds and effective amounts of about 0.005–0.2 g/l of the primary brighteners, with about 1.0–30 g/l of the secondary brightener, with about 0.5–10 g/l of the secondary auxiliary brightener, and with about 0.05–1 g/l of anti-pitting agent, described herein are summarized below.

Typical aqueous nickel-containing electroplating baths (which may be used in combination with effective amounts of the hydroxy-sulfonate and cooperating additives) include the following wherein all concentrations are in grams per liter (g/l) unless otherwise indicated:

TABLE I

AQUEOUS NICKEL-CONTAINING ELECTROPLATING BATHS

| Component | Minimum | Maximum | Preferred |
|---|---|---|---|
| nickel sulfate | 200 | 500 | 300 |
| nickel chloride | 30 | 80 | 45 |
| boric acid | 35 | 55 | 45 |
| pH (electrometric) | 3 | 5 | 4 |

A typical sulfamate-type nickel plating bath which may be used in practice of this invention may include the following components:

TABLE II

| Component | Minimum | Maximum | Preferred |
|---|---|---|---|
| nickel sulfamate | 330 | 400 | 375 |
| nickel chloride | 15 | 60 | 45 |
| boric acid | 35 | 55 | 45 |
| pH (electrometric) | 3 | 5 | 4 |

A typical fluoborate-type nickel plating bath which may be used in the practice of the invention may include the following components:

TABLE III

| Component | Minimum | Maximum | Preferred |
|---|---|---|---|
| nickel fluoborate | 250 | 400 | 300 |
| nickel chloride | 45 | 60 | 50 |
| boric acid | 15 | 30 | 20 |
| pH (electrometric) | 2 | 4 | 3 |

A typical chloride-free sulfate-type nickel plating bath which may be used in practice of this invention may include the following components:

TABLE IV

| Component | Minimum | Maximum | Preferred |
|---|---|---|---|
| nickel sulfate | 300 | 500 | 400 |
| boric acid | 35 | 55 | 45 |
| pH (electrometric) | 3 | 5 | 4 |

A typical chloride-free sulfamate-type nickel plating bath which may be used in practice of this invention may include the following components:

TABLE V

| Component | Minimum | Maximum | Preferred |
|---|---|---|---|
| nickel sulfamate | 300 | 400 | 350 |
| boric acid | 35 | 55 | 45 |
| pH (electrometric) | 3 | 5 | 4 |

It will be apparent that the above baths may contain compounds in amounts falling outside the preferred minimum and maximum set forth, but most satisfactory and economical operation may normally be effected when the compounds are present in the baths in the amounts indicated. A particular advantage of the chloride-free baths of Tables IV and V, supra, is that the deposits obtained may be substantially free of tensile stress and may permit high speed plating involving the use of high speed anodes.

The following are aqueous cobalt-containing and cobalt-nickel-containing electroplating baths in which the combination of effective amounts of one or more hydroxysulfonates and cooperating additives according to this invention will result in improving the tolerance of the bath to metallic ions such as zinc ions even when used jointly with other additives, such as iodides. When an ionic iodide additive is employed, an iodide ion concentration of 0.5–5 g/l may be used.

AQUEOUS COBALT-CONTAINING AND COBALT-NICKEL-CONTAINING ELECTROPLATING BATHS
(All concentrations in g/l unless otherwise noted)

| | Maximum | Minimum | Preferred |
|---|---|---|---|
| VI. Cobalt Bath | | | |
| CoSO d $4.7H_2O$ | 400 | 200 | 300 |
| $CoCl_2.6H_2O$ | 75 | 15 | 60 |
| $H_3BO_3$ | 50 | 37 | 45 |
| VII. Cobalt Bath | | | |
| $CoSO_4.7H_2O$ | 500 | 300 | 400 |
| NaCl | 50 | 15 | 30 |
| $H_3BO_3$ | 50 | 37 | 45 |
| VIII. High chloride Cobalt Bath | | | |
| $CoSO_4.7H_2O$ | 350 | 150 | 225 |
| $CoCl_2.6H_2O$ | 350 | 150 | 225 |
| $H_3BO_3$ | 50 | 37 | 45 |
| IX. Cobalt-Nickel Alloy Bath | | | |
| $NiSO_4.7H_2O$ | 400 | 200 | 300 |
| $CoSO_4.7H_2O$ | 225 | 15 | 80 |
| $NiCl_2.6H_2O$ | 75 | 15 | 60 |
| $H_3BO_3$ | 50 | 37 | 45 |
| X. All-Chloride Cobalt Bath | | | |
| $CoCl_2 \cdot 6H_2O$ | 500 | 200 | 300 |
| $H_3BO_3$ | 50 | 37 | 45 |
| XI. Sulfamate Cobalt Bath | | | |
| $Co(O_3SNH_2)_2$ | 400 | 200 | 290 |
| $CoCl_2.6H_2O$ | 75 | 15 | 60 |
| $H_3BO_3$ | 50 | 37 | 45 |

Preferred cobalt-containing bath compositions may contain at least about 30 g/l of $CoCl_2.6H_2O$, and typically 20–50 g/l of $CoCl_2.6H_2O$. Other compounds which have a bath compatible cation (i.e. a cation which does not interfere with the operation of the bath) which will provide at least 7.5 g/l of chloride ion, $Cl^-$ (and preferably a minimum of about 9 g/l of $Cl^-$) may also be used.

The pH of all of the foregoing illustrative aqueous nickel-containing, cobalt-containing, and nickel-cobalt containing compositions may be maintained during plating at pH values of 2.5 to 5.0, and preferably from about 3.5 to 4.5. During bath operation, the pH may normally tend to rise and may be adjusted with acids such as hydrochloric acid or sulfuric acid, etc. Other buffering components in addition to or in place of boric acid (such as formates, citrates, etc.) may also be used for buffering if necessary or desirable.

The following examples are submitted for the purpose of illustration only and are not to be construed as limiting the scope of the invention in any way.

EXAMPLE 1

A nickel electroplating bath composition was prepared by combining in water the following ingredients to provide the indicated concentrations (in g/l unless indicated otherwise).

| | Concentration (g/l) |
|---|---|
| $NiSO_4.7H_2O$ | 300 |
| $NiCl_2.6H_2O$ | 60 |
| $H_3BO_3$ | 45 |
| sodium saccharinate (0.6 mole $H_2O$) | 3.8 |
| sodium di-n-hexyl sulfosuccinate | 0.125 |
| pH (electrometric) | 3.8 |

A polished brass panel was cleaned and plated in a 267 ml. Hull Cell at 2 amperes cell current for 10 minutes at a temperature of 50°C. and using magnetic stirring. The resulting deposit was uniformly fine-grained, glossy in appearance, with excellent ductility and a uniform milky haze. On adding to the solution the equivalent of 0.08 g/l (80 ppm) of $Zn^{++}$, as a solution of zinc sulfate and repeating the plating test, the low current density end of the range from about 0 to 1.6 asd (amperes per square decimeter) was badly striated and dark in color with scattered areas which were very thin in thickness and dark, i.e. where the deposit thickness was substantially lower than on adjacent elevated thicker deposits.

To the zinc-contaminated solution an amount of sodium hydroxymethyl sulfonate additive sufficient to provide a concentration of 1 g/l was added, and the plating test then repeated. An excellent deposit was then again obtained with total elimination of low current density deposit striation, thinness, and darkness of color, showing that the bath had been effectively regenerated.

EXAMPLE 2

Example 1 was repeated using 1 g/l additive of disodium-1-hydroxy-1,3-propane disulfonate in place of additive sodium hydroxymethyl sulfonate with substantially identical beneficial effects attained, the bath being again rendered zinc-tolerant after contamination with zinc ions had previously rendered the bath unsatisfactory for further plating.

EXAMPLE 3

Example 1 was repeated using 1 g/l of disodium-$\alpha$-sulfo-glycolate additive in place of additive sodium hydroxymethyl sulfonate with substantially identical beneficial effects attained. The regenerated bath composition was rendered zinc-tolerant after addition of 1 g/l of disodium-$\alpha$-sulfo-glycolate and the bath rendered capable of substantially increased bath life.

EXAMPLE 4

Example 1 was repeated using 1 g/l of sodium 1-glycerol sulfonate in place of additive sodium hydroxymethyl sulfonate with substantially identical beneficial results attained. The regenerated bath composition was rendered zinc-tolerant after addition of 1 g/l of sodium 1-glycerol sulfonate.

EXAMPLE 5

A nickel electroplating bath composition was prepared by combining in water the following ingredients to provide the indicated concentrations (in g/l unless otherwise indicated):

| Ingredient | Concentration (g/l) |
|---|---|
| $NiSO_4.7H_2O$ | 300 |
| $NiCl_2.6H_2O$ | 60 |
| $H_3BO_3$ | 45 |
| sodium saccharinate (0.6 moles $H_2O$) | 3.8 |
| sodium allyl sulfonate | 2.3 |
| 2-butyene-1,4-diol | 50 mg/l |
| bis-$\beta$-hydroxy ethyl ether of 2-butyne-1,4-diol | 25 mg/l |
| N-1,2-dichloropropenylpyridinium chloride | 10 mg/l |
| sodium di-n-hexylsulfosuccinate | 0.125 |
| pH (electrometric) | 3.8 |

A polished brass panel was cleaned and plated in a 267 ml. Hull Cell at 2 amperes cell current for 10 minutes at a temperature of 50°C. using magnetic stirring. The resulting nickel electrodeposit was brilliant, highly leveled, with excellent ductility and low current density coverage (as evidenced by the extent of the nickel electrodeposit coverage on the back of the panel away from the nickel anode.).

To the above nickel electroplating bath composition was added an amount of zinc sulfate solution to produce a concentration of 0.08 g/l of $Zn^{++}$. The plating test was then repeated using an identical clean, polished, brass panel and employing the same plating conditions used prior to contamination of the nickel electroplating bath with zinc ions. The resulting nickel electroplated panel had a dark, thin, and badly striated electrodeposit on the low current density areas of the panel and it was apparent that the low current density coverage had been drastically reduced due to the presence of zinc ion as contaminant.

To portions of the zinc-contaminated nickel electroplating bath composition were added amounts of sodium hydroxymethyl sulfonate, disodium 1-hydroxy-1,3-propane disulfonate, disodium-2-sulfo-glycolate, and sodium 1-glycerol sulfonate to provide concentrations of 1 g/l of each additive and the electroplating carried out using the same conditions as were initially employed. In each case, the excellent plating characteristics of the original bath composition were restored.

The restored plating bath compositions were heated at 50°C. for an average of eight hours per day with continuous stirring for a time period of five days. Frequent plating tests using the same conditions and identical panels were carried out with the contaminated restored plating baths to determine the operational characteristics of each restored bath composition. All of the additives showed excellent restoration for at least two days and sodium hydroxymethyl sulfonate was still effective at the end of the five day period with the restored bath composition still showing excellent zinc tolerance.

Addition of 1 g/l $NaHSO_3$ gives dull unacceptable electrodeposits and this shows that this amount of bisulfite is excessive.

In another comparison using the zinc-contaminated bath of this example, an amount of sodium bisulfite sufficient to produce a concentration of 0.04 g/l was added to the contaminated bath composition in place of the organic hydroxysulfonate additives of the invention. The zinc-tolerance was greatly improved as shown by repetition of the plating test using an identical clean brass panel and the same plating conditions as employed with the original uncontaminated bath composition. However, after stirring the restored bath composition at 50°C. for about 2 hours, poor plating characteristics were again observed, thus demonstrating the unexpected superiority of the length of the restoration period for the contaminated bath which is restored using the organic hydroxy-sulfonate additives of this invention.

In another comparison using the zinc contaminated bath of this example an amount of sodium bisulfite sufficient to produce a concentration of 0.775 g/l was added to the contaminated bath composition in place of the organic hydroxy-sulfonate additives of the invention. On repeating the plating test the deposit had practically no leveling, was hazy in the range of 0 to about 0.8 asd, had scattered hazy spots in the range of about 0.8 to 12 asd and the portion of the deposit receiving the maximum degree of agitation during plating i.e. in a band extending about 1 cm from the bottom of the panel, was badly spontaneously cracked with the higher current density portion microcracked and the lower current density portion macrocracked. The deposit also had a dark brownish cast. Therefore, although the zinc contamination was counteracted by eliminating the extensive low current density striations and deposit thinness and darkness the deposit was otherwise unacceptable for bright nickel plating purposes. The test was repeated using 0.04 g/l of sodium hydroxymethyl sulfonate in place of the sodium bisulfite and an acceptable deposit was obtained i.e. low current density effects were almost completely eliminated except for a slight darkness and thinness of deposit in the range of 0 to 0.2 asd.

In a similar comparison of the organic hydroxysulfonate additives of the invention herein using the same contaminated bath composition but with a 1 g/l concentration of sodium benzene monosulfinate instead of the organic hydroxy-sulfonate compounds of the invention herein, it was found that the sodium benzene monosulfinate provided improved zinc tolerance for the contaminated bath composition, but the leveling characteristics (as evidenced by the degree to which the electrodeposit filled a standard scratch placed on the brass panel prior to plating with 4/0 grit emery paper) were completely lost.

EXAMPLE 6

A nickel electroplating bath composition was prepared by combining in water the following ingredients to provide the indicated concentrations (in g/l unless otherwise indicated):

| Ingredient | Concentration g/l |
|---|---|
| $NiSO_4.7H_2O$ | 300 |
| $NiCl_2.6H_2O$ | 60 |
| $H_3BO_3$ | 45 |
| sodium saccharinate (0.6 moles $H_2O$) | 3.8 |

-continued

| Ingredient | Concentration g/l |
|---|---|
| sodium allyl sulfonate | 2.3 |
| 2-methyl-3-butyn-2-ol | 10 mg/l |
| N-1,2-dichloropropenyl pyridinium chloride | 10 mg/l |
| sodium di-n-hexylsulfosuccinate | 0.125 |

Using the plating conditions set forth in Example 1, a brilliant, well-leveled ductile deposit was obtained, but an area in the low current density end of the panel (corresponding to a current density of from about 0 to 0.8 asd) was generally thin, dark, non-uniform, and partially striated.

To samples of the foregoing bath composition were added amounts of sodium hydroxymethyl sulfonate, disodium 1-hydroxy-1,3-propane disulfonate, disodium-α-sulfo-glycolate, and sodium 1-glycerol sulfonate, to provide concentrations of about 1 g/l of each additive in each sample. New clean identical brass panels were then electroplated using each bath sample under the same conditions as employed in Example 1 to produce nickel plated panels with excellent luster, coverage, color and uniformity in the previously defective low current density end of the panels with the complete absence of any indication of thin, dark, or striated areas on the panels.

EXAMPLE 6

To the original uncontaminated bath of Example 1 there were added the following additional organic additives:

| | | |
|---|---|---|
| (1) | sodium allyl sulfonate | 2.3 g/l |
| (2) | bis-β-hydroxyethylether of 2-butyne-1,4-diol | 75 mg/l |
| (3) | 2-butyne-1,4-diol | 9 mg/l |
| (4) | propargyl alcohol | 9 mg/l |

The amounts of the last three primary brightenertype additives used were about a 50% excess over optimum for each ingredient in this particular primary brightener combination.

On running a plating test as described in Example 1, the low current density characteristics of the deposit were about the same a described in Example 5; that is, the portion of the panel corresponding to a current density of 0.0.8 asd had a thin, dark, non-uniform and striated deposit. The addition of 1 g/l of additive, sodium hydroxymethyl sulfonate, disodium 1-hydroxy -1,3-propane disulfonate, disodium-α-sulfoglycolate, or sodium 1-glycerol sulfonate, resulted in an excellent deposit in the low current density end of the range characterized by excellent luster, coverage, color and uniformity of deposit with the complete absence of thin, dark, striated areas.

EXAMPLE 7

A cobalt electroplating bath composition was prepared by combining in water the following ingredients to provide the indicated concentrations (in g/l unless indicated otherwise):

| Ingredient | Concentration g/l |
|---|---|
| $CoSO_4.7H_2O$ | 300 |
| $CoCl_2.6H_2O$ | 60 |
| $H_3BO_3$ | 45 |
| sodium saccharinate (0.6 moles $H_2O$) | 3.8 |
| bis-β-hydroxyethyl ether of 2-butyne-1,4-diol | 50 mg/l |

-continued

| Ingredient | Concentration g/l |
|---|---|
| sodium allyl sulfonate | 2.3 |
| sodium di-n-hexyl sulfosuccinate | 0.025 |

On running a plating test as described in Example 6, the deposit was non-uniformly dull with a pronounced brownish cast. On adding the equivalent of 1 g/l sodium hydroxymethyl sulfonate, disodium 1-hydroxy-1,3-propane disulfonate, disodium-α-sulfo-glycolate, or sodium 1-glycerol sulfonate additive, a brilliant, well-leveled cobalt electrodeposit was obtained in each case with the exception of a small dull iridescent brownish area adjacent to the high current density edge of the panel and about 1 square cm. in total area. This high current density dull area was eliminated by adding 0.1 g/l NaI. Without the organic hydroxy-sulfonate additives of the invention herein, at least about 0.75 g/l of NaI would have been required to obtain equivalent good results.

EXAMPLE 9

A nickel-cobalt alloy electroplating bath was prepared by combining in water the following ingredients to provide the indicated concentrations:

| Ingredient | Concentration g/l |
|---|---|
| $NiSO_4.7H_2O$ | 300 |
| $NiCl_2.6H_2O$ | 60 |
| $CoSO_4.7H_2O$ | 60 |
| $H_3BO_3$ | 40 |
| sodium benzene monosulfonate | 7.5 |
| sodium allyl sulfonate | 2.3 |
| 2-methyl-3-butyn-2-ol | 0.01 |
| N-1,2-dichloropropenyl pyridinium chloride | 0.01 |
| sodium di-n-hexyl sulfosuccinate | 0.025 |
| pH (electrometric) | 3.8 |

On plating a brass panel in a Hull Cell in this solution under the same conditions as in Example 1, the deposit was very non-uniformly milky to dull and only partial low current density coverage was obtained. On adding 1 g/l of sodium hydroxymethyl sulfonate, disodium 1-hydroxy-1,3-propane disulfonate, disodium-α-sulfo-glycolate, or sodium 1-glycerol sulfonate additive to the Hull Cell solution for three different samples of the same bath composition and repeating the Hull Cell test, a brilliant, well-leveled, quite ductile deposit was obtained which had excellent low current density coverage. The anode used in this test was nickel.

As can be seen from the foregoing examples and the remainder of the specification herein, the use of a compound which contains a carbon atom having both a hydroxyl groups and a sulfonate group attached to the same carbon atom provides uniquely unexpected improvements in the nickel, cobalt, and nickel-cobalt plating art.

Although this invention has been illustrated by reference to specific embodiments, modifications thereof which are clearly within the scope of the invention will be apparent to those skilled in the art.

I claim:

1. A compound of the formula:

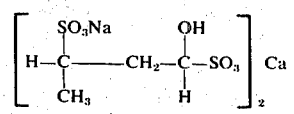

* * * * *